US005255887A

United States Patent [19]

Schumacher et al.

[11] Patent Number: 5,255,887

[45] Date of Patent: * Oct. 26, 1993

[54] SUPPORT FOR AIR CONDITIONING UNIT

[75] Inventors: J. Gunther Schumacher; Maurizio Lattanzio, both of Richmond Hill, Canada

[73] Assignee: Spinnaker Industries Inc., Concord, Canada

[ * ] Notice: The portion of the term of this patent subsequent to Feb. 23, 2010 has been disclaimed.

[21] Appl. No.: 890,636

[22] Filed: May 28, 1992

Related U.S. Application Data

[63] Continuation-in-part of Ser. No. 731,108, Jul. 15, 1991, Pat. No. 5,188,333.

[51] Int. Cl.[5] ..... F16M 3/00

[52] U.S. Cl. ..... 248/676; 220/4.09; 248/224.4

[58] Field of Search ..... 248/676, 672, 637, 150, 248/165, 224.4, 225.1, 678; 108/56.1; 62/259.1; 220/4.09, 4.11

[56] References Cited

U.S. PATENT DOCUMENTS

| | | | |
|---|---|---|---|
| 1,500,917 | 7/1924 | Bell | 220/409 |
| 2,218,220 | 10/1940 | Riehl | 101/404 |
| 2,660,271 | 11/1953 | Hupp | 189/36 |
| 2,882,810 | 4/1959 | Goettl | 98/30 |
| 4,399,975 | 8/1983 | Trimarco | 248/678 |
| 4,423,978 | 1/1984 | Tiegelmann | 403/254 |
| 4,635,562 | 1/1987 | Kreeger | 108/56.1 |
| 4,887,399 | 12/1989 | Berger et al. | 52/27 |
| 4,895,066 | 1/1990 | Carnahan | 98/42.22 |
| 4,916,918 | 4/1990 | Marelli | 62/259.1 |
| 4,917,345 | 4/1990 | Czech | 248/678 |
| 5,188,333 | 2/1993 | Schumacher et al. | 248/676 |

*Primary Examiner*—Ramon O. Ramirez
*Attorney, Agent, or Firm*—Baker & Daniels

[57] ABSTRACT

A frame for supporting a piece of equipment, particularly an air conditioning unit, onto the roof of a building is constructed using fastener means integral to the sheet metal so that the use of nuts, bolts or other fastening devices is eliminated. In particular, the fastening means comprise a slot cut into one piece of sheet metal and a dimple and tongue punched out of a second piece of sheet metal. The tongue is slipped into and over the slot until the dimple locks into the slot and thus holds the two pieces of sheet metal together.

21 Claims, 4 Drawing Sheets

SUPPORT FOR AIR CONDITIONING UNIT

This application is a continuation in part of U.S. application Ser. No. 731,108 filed Jul. 15, 1991, now U.S. Pat. No. 5,188,333.

The present invention is concerned with a support for a piece of equipment and more particularly with a support for mounting air conditioning units on the roof of a building.

During the installation of air conditioning units on the roofs of buildings, numerous problems are encountered. One such problem is related to the use of a support or frame upon which the air conditioning unit is mounted.

Supports for air conditioning units are usually custom built in properly equipped shops and then installed on the building roof. Because most supports involve complicated assembly procedures, this procedure usually requires repeated travel between the shop and the building to ensure the support is built so as to fit properly.

Such supports are built of sheet metal, which must be fastened and held together. In some cases, the sheet metal is welded together, but this is problematic because if the welding is done at the shop, the completed support must be transported to the building and mounted on the roof. On the other hand, if the welding is done on site, the welding equipment must be transported to the site and the welding is done on the roof, which can be awkward.

Another way of securing the sheet metal together so as to form a support is by using nuts and bolts. However, this requires ensuring that sufficient nuts and bolts are taken to the roof of the building.

Also, nuts and bolts may have to be installed in hard to reach places, making installation difficult. Finally, using nuts and bolts creates a danger in the sense that there is a likelihood that a workman may drop a nut or bolt down the ventilation shaft and into equipment.

U.S. Pat. No. 2,882,810 issued Apr. 1, 1959 discloses an Adjustable Support for Evaporative Coolers wherein neither welding nor nuts and bolts are used. However, the support's sides are secured to one another by clips that slide over flanges extending from the sides. The clips are not integral to the frame and thus present the same problems as nuts and bolts do.

U.S. Pat. No. 4,887,399 issued Dec. 19, 1989 discloses a frame made of individual elements interconnected by brackets, which appear to have to be bolted or secured by metal screws to the support. Again, this presents the same problem.

In general terms the present invention provides a frame for supporting a piece of equipment on the roof of a building comprising a plurality of walls each having portions overlapping with portions of the other walls, a plurality of spaced apart fastener means integral to the walls and located on the overlapping portions and adapted to hold the walls together such that the walls define a frame.

More particularly the invention provides a frame for supporting a piece of equipment on the roof of a building in which the walls are held together by fastening means comprising a slot, a tongue adapted to slip into and over the slot and a dimple adapted to lock into the slot when the tongue is slipped over the slot.

In another aspect the invention provides a fastening device for securing a pair of panels together comprising a tongue integrally formed in one of the panels and which is generally parallel to the panel and is connected to the panel such that a channel is defined between the tongue and the panel. The device further comprises a latching member spaced from the tongue and directed in an opposite direction to the channel, and an aperture in the other panel having a length sufficient to accommodate the tongue and to extend beyond the latching member so that relative movement between the panels is prohibited.

Embodiments of the present invention are illustrated in the accompanying drawings, in which like numerals denote like parts throughout the several views and in which.

Figure 1:
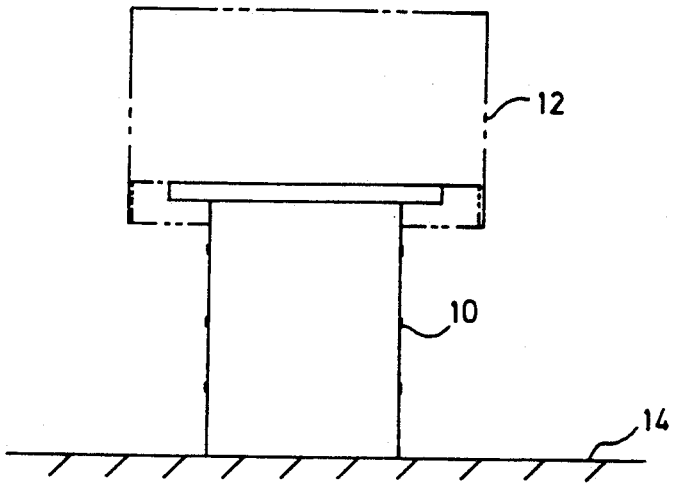
FIG. 1 is a side elevational view of a frame for supporting a piece of equipment.
Figure 2:
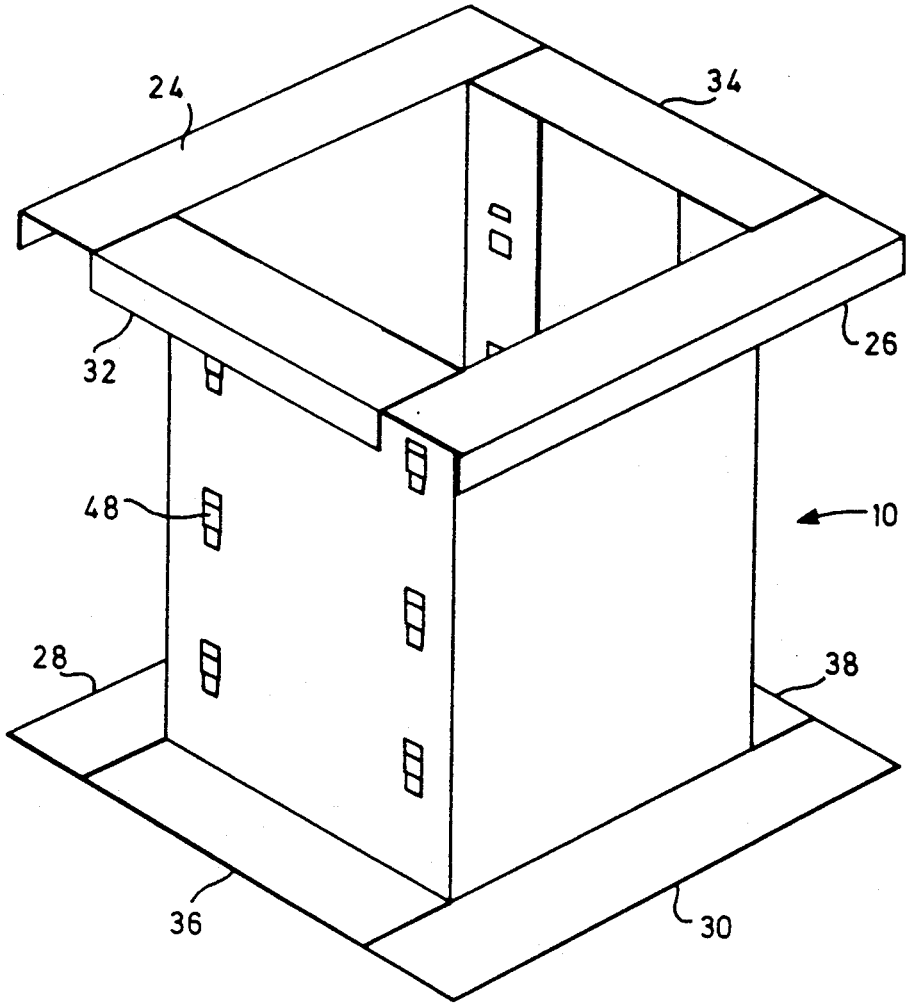
FIG. 2 is a perspective view of the frame in in FIG. 1.
Figure 3:
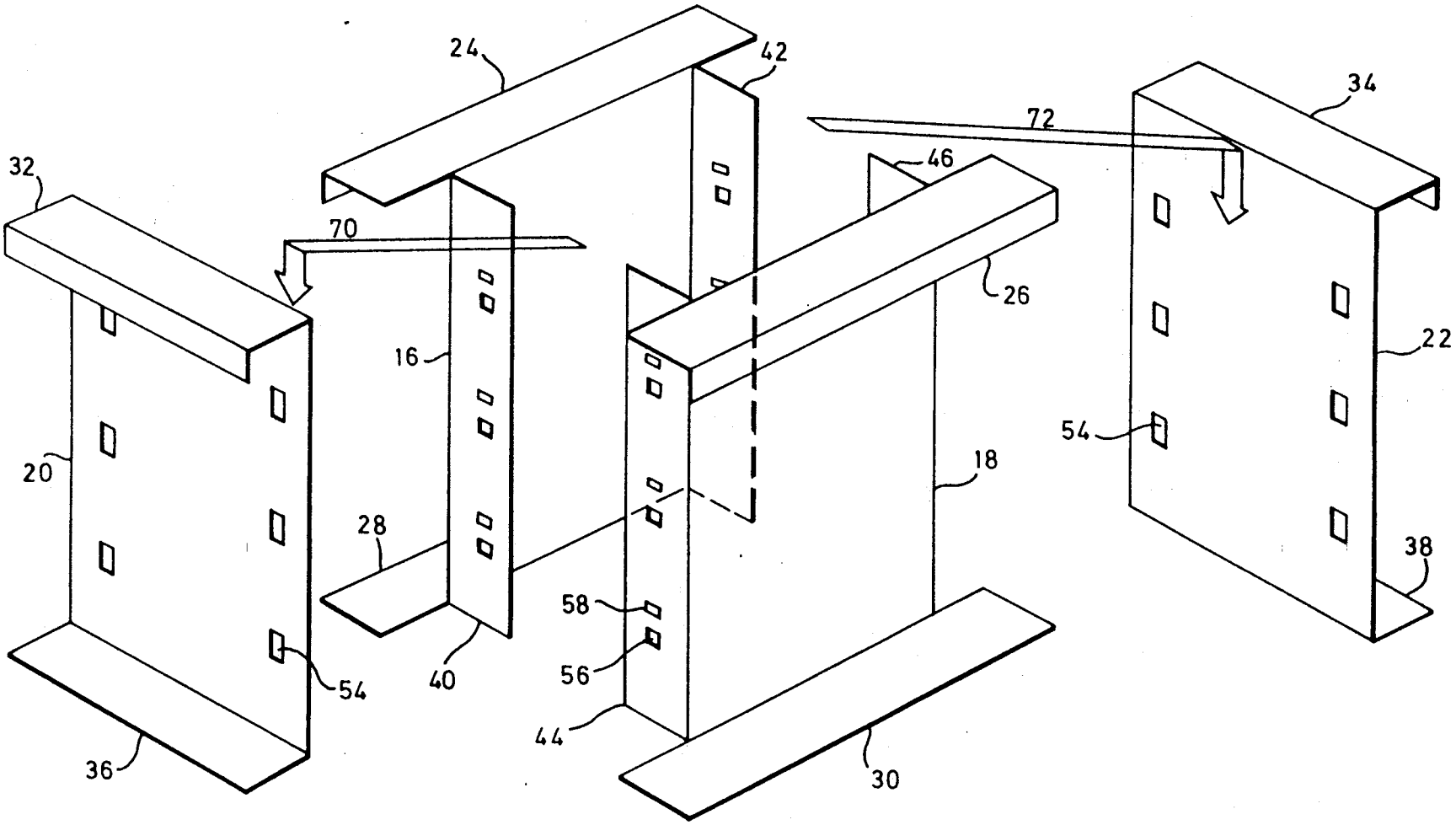
FIG. 3 is an exploded perspective view of the frame in FIG. 1.

With reference to FIGS. 1, 2 and 3 there is shown a frame 10 for supporting a piece of equipment 12, particularly an air conditioning unit, on the roof of a building 14.

As seen more clearly in FIGS. 2 and 3, the frame comprises two side walls 16 and 18 and two end walls 20 and 22. Side walls 16 and 18 and end walls 20 and 22 are panels having substantially flat top and bottom surfaces. Side walls 16 and 18 and end walls 20 and 22 are preferably made of somewhat resilient or deformable material such as sheet metal or the like, having a small thickness relative to their lengths and widths. Side walls 16 and 18 both have top flanges 24 and 26 respectively and bottom flanges 28 and 30 respectively. End walls 20 and 22 also have top flanges 32 and 34 respectively and bottom flanges 36 and 38 respectively. Top flanges 24 and 26 and bottom flanges 28 and 30 are each longer than the widths of side walls 16 and 18 such that when end walls 20 and 22 are fastened to side walls 16 and 18, the top flanges define a continuous peripheral flange around the top of the frame and the bottom flanges define a continuous peripheral flange around the bottom of the frame.

Side wall 16 also includes side flanges 40 and 42 which extend perpendicularly to the plane of side wall 16 so as to lie alongside end walls 20 and 22 respectively. Similarly, side wall 18 also comprises side flanges 44 and 46 which extend perpendicularly to the plane of side wall 18 so as to lie alongside end walls 20 and 22 respectively.

Side walls 16 and 18 are oriented such that side flanges 40 and 42 of side wall 16 extend towards side flanges 44 and 46 of side wall 18. End walls 20 and 22 are each made so that a portion thereof overlaps with each of side flanges 40, 42, 44 and 46.

A plurality of fasteners 48 are located on each of side flanges 40, 42, 44 and 46 and on each of the portions of end walls 20 and 22 which overlap with the respective side flanges. Fasteners 48 are aligned in a substantially vertical direction along the respective side flanges and respective portion of end walls 20 and 22.

Referring to FIGS. 4 to 8, fastener 48 comprises a slot 54 cut into one of the components, in this case panel 50, a tongue 56 punched out of the second component, panel 52 and a latch 58 also punched out of panel 52.

Tongue 56 and latch 58 are integral to panel 52. Tongue 56 is connected to panel 52 by a connector 60, which extends substantially perpendicularly to panel 52. Tongue 56 is generally parallel to panel 52 and is spaced apart from the top surface of panel 52 such that the channel 62 is defined by the bottom surface of tongue 56 and the top surface of panel 52 is sufficient to allow the thickness of panel 50 to slide within channel 62.

Latch 58 is defined by a tab 68 inclined to the plane of the panel 52 and also punched out from panel 52, so as to be integral to it. The peripheral free edge of the tab 68 includes an end surface 64 which is raised above the top surface of panel 52 to a point just before end 64 is raised completely above the top surface plane of panel 52. Latch 58, being integral to panel 52, is somewhat resilient or deformable such that end 64 can be lowered upon the application of pressure thereon.

Figure 6:
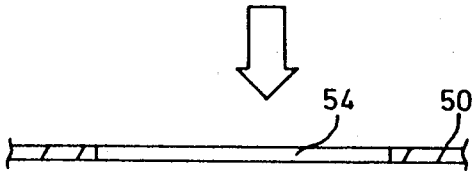
FIG. 6 is a sectional view taken from the line 6—6 of FIG. 5.
Figure 6:
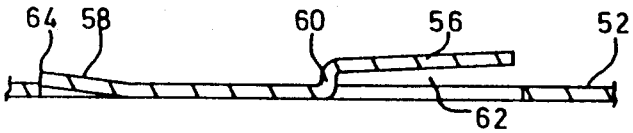
Figure 7:
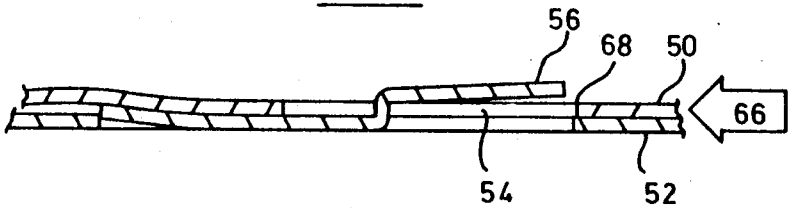
FIG. 7 is a sectional view taken from the line 6—6 of FIG. 5 showing the components partly assembled.
Figure 8:
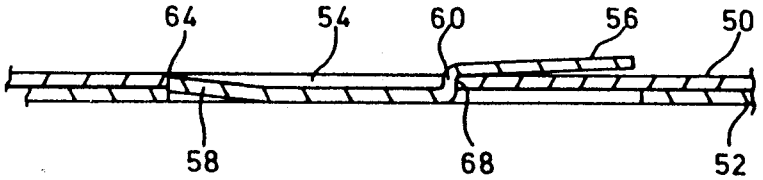
FIG. 8 is a sectional view taken from the line 6—6 of FIG. 5 showing the components fully assembled.
Figure 4:
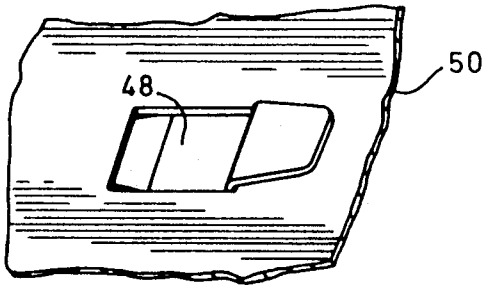
FIG. 4 is a perspective view of a portion of the frame of FIG. 1 showing the manner in which two components are fastened.
Figure 5:
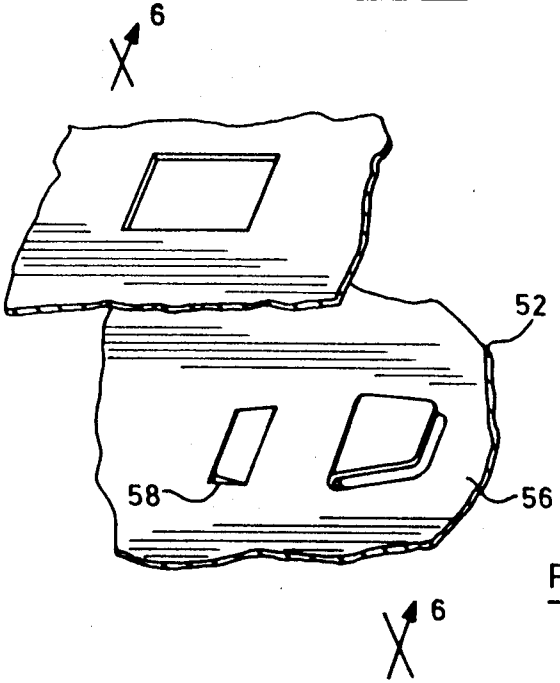
FIG. 5 is a perspective view of the portion in FIG. 4 showing the two components apart.

The operation of fastening panel 50 to panel 52 is more clearly shown in FIGS. 6, 7 and 8. Panel 50 is brought towards panel 52 such that tongue 56 slips into slot 54 and until the bottom surface of panel 50 abuts with the top surface of panel 52.

Panel 50 is then slid along panel 52 in the direction illustrated by arrow 66. Latch 58 is deformable therefore allowing the bottom surface of panel 50 to slide over latch 58. As panel 50 is moved in the direction of arrow 66, tongue 56 slides over slot 54 and overlies a portion of panel 50 adjacent to peripheral edge 67 of slot 54. Eventually, edge 67 of slot 54 will contact with the inner surface of connector 60 of tongue 56.

The length of slot 54 is such that it is equal to or slightly greater than the distance between end surface 64 of latch 58 and the inner surface of connector 60 of tongue 56. As such, when edge 67 of slot 54 contacts the inner surface of portion 60, end 64 of latch 58 snaps into slot 54 thereby causing panel 50 to be secured to and held together with panel 52. The end surface 64 of latch 58 prevents movement of panel 50 in a direction opposite to arrow 66, and the free edges of tab 68 extending from the end surface 64 also prevent relative sliding motion between the panels 50, 52. Tongue 56 is therefore maintained in a position to overlie a portion of panel 50 and prevents movement of panel 50 away from panel 52.

It is also understood that the components of fastener 48 can be interchanged such that slot 54 is located on panel 52 and tongue 56 and latch 58 are located on panel 50.

FIG. 3 further illustrates the operation of fastener 48 in the context of a frame for supporting a piece of equipment. Tongue 56 and latch 58 are located on side flanges 40, 42, 44 and 46 of side walls 16 and 18. Tongue 56 and latch 58 are oriented in a substantially vertical direction. Slots 54 are located on the portions of end walls 20 and 22 which overlap with the side flanges. To secure end walls 20 and 22 onto side walls 16 and 18, side walls 16 and 18 are moved in the direction of arrows 70 and 72 respectively. As such, slots 54 are slipped over tongues 56 and the respective side wall 16 or 18 is then moved in the direction of arrows 70 and 72 so that tongues 56 slide over the portions of side walls 20 and 22 adjacent to slots 54 until latches 58 snap into slots 54. Latches 58 prevent end walls 20 and 22 from moving in the direction of arrows 70 and 72 respectively whereas tongues 56 prevent end walls 20 and 22 from moving away from the side flanges.

When end walls 20 and 22 are fastened to the side flanges of side walls 16 and 18, all four walls define a frame as illustrated in FIG. 2. The respective walls are securely held together by fasteners 48 which are integral to end walls 20 and 22 and side walls 16 and 18. Therefore, the need for welding the walls together or for nuts and bolts or other separate fastening devices is eliminated. The frame 10 can then be secured onto the roof of the building by the peripheral bottom flanges 28, 30, 36 and 38. A piece of equipment 12, particularly an air conditioning unit, can be mounted onto frame 10 and secured onto frame 10 by means of the peripheral top flanges 24, 26, 32 and 34.

In the embodiment shown in FIGS. 1 to 8, the latches 58 are effective to prevent separation of the panels in direction opposite to that of their assembly, i.e., opposite to the arrow 66. This is satisfactory where the loads imposed on the panel are aligned with the direction of assembly. In certain circumstances however, the design of panel dictates that assembly must occur in a direction transverse to the loads. With such loading, the lateral edges of the latch 58 which are inclined to the plane of panel 52 may act as a cover and force the latch into the plane of the panel 52 to release the tongue from the slot 54.

Figure 10:
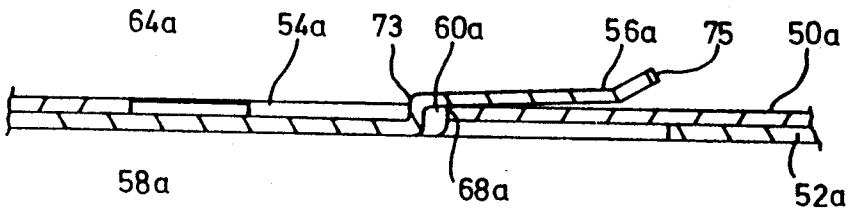
FIG. 10 is a view similar to FIG. 8 showing the embodiment of FIG. 9 assembled.
Figure 11:
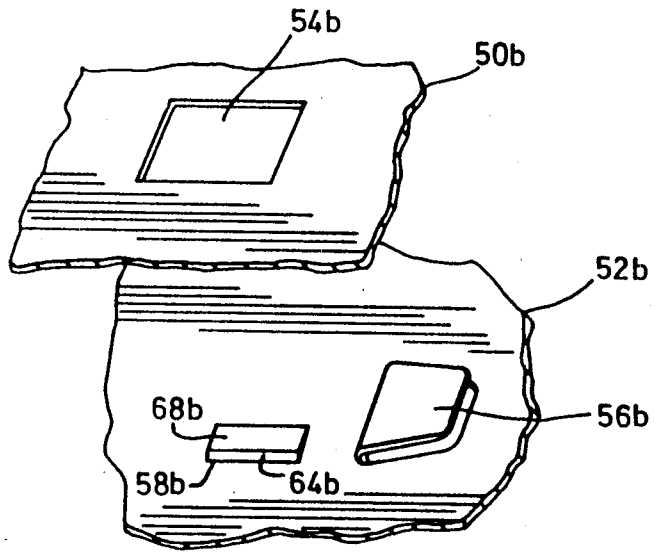
FIG. 11 is a view similar to FIG. 9 of a yet further embodiment.
Figure 9:
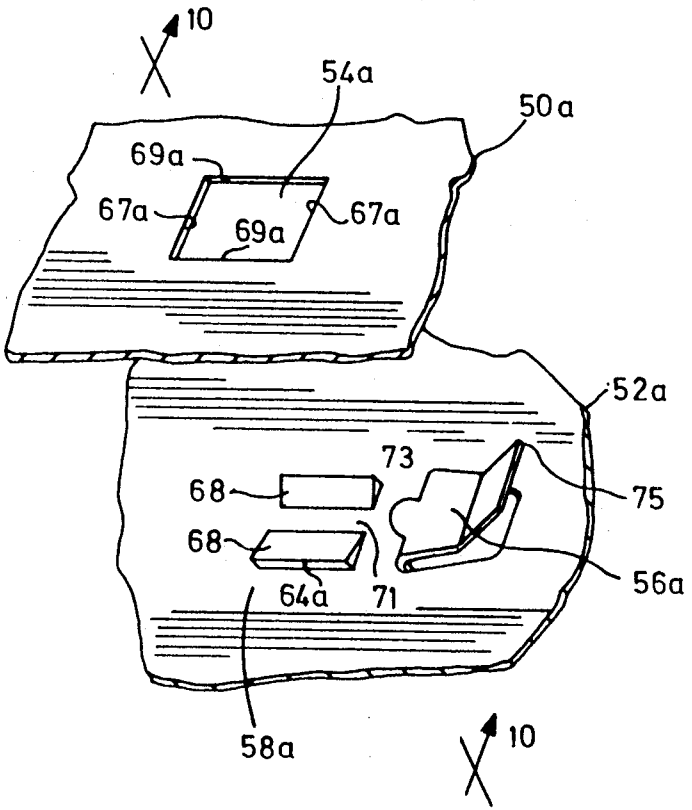
FIG. 9 is a view similar to FIG. 5 of an alternative embodiment.

The embodiments shown in FIGS. 9 and 11 avoid this by providing an abutting edge of the latch that is parallel to the direction of assembly and parallel to the plane of the panel. Thus, referring to FIGS. 9 and 10 in which like reference numerals identify like components with a suffix "a" added for clarity, latch 58*a* is formed from a pair of tabs 68*a* each having an edge 64*a* disposed parallel to the lateral edges of slot 54*a*. Each of the tabs 68 is punched out of panel 52*a* so as to be free along three sides and inclined to the plane of the panel 52*a*. The inner edges of tabs 68 are spaced apart sufficiently to provide a land 71 that retains the resilience of the latches 58*a* relative to panel 52*a*.

The connector 60*a* is formed with a centrally disposed rib 73 which is upset at the same time as the tongue 56*a* is punched from the panel to increase the stiffness of the connector 60*a* to bending. This in turn improves the resistance to separation of the panels 50*a*, 52*a* such as might occur by deformation of the connector if sufficiently large loads are applied.

To facilitate assembly of the panels 50*a*, 52*a*, the distal end of tongue 56*a* is kicked up as indicated at 75 to provide a progressive lead into the edge of slot 54*a*.

Assembly of the panels 50*a*, 52*a* is similar to that shown with respect to FIGS. 6 to 8 above. The panel 50*a* is positioned so that the slot 54*a* is located over the 56*a* and the panels slid so that panel 52*a* is engaged by the tongue 56*a*. The tabs 68*a* are deformed into the plane of the panel 52*a* until the edge of the slot 54*a* extends beyond the latches 58*a*. The tabs 68*a* spring into the slot 58*a* so that the edges 64*a* abut the lateral edges 69. In this position the edges 64*a* are positioned to resist lateral loads imposed on the panels 50*a*, 52*a* and the side edges of each of the tabs 68*a* inhibits sliding of the panels in a direction to release tongue 56*a*.

A further embodiment is shown in FIG. 11 in which a single tab 68*b* is provided with edge 64*b* disposed generally parallel to direction of assembly with one of the side edges of tab 68*b* being directed oppositely to the channel defined by the tongue 56*b*.

It will of course be apparent that configurations of tabs could be utilized other than rectangular, for example, part circular and that the edge 64*a* could be disposed other than parallel or normal to the direction of assembly. In each embodiment however the latch is effective to resist the shear loads applied between the panels and maintain the tongue in a position to prevent separation of the panels.

We claim:

1. A frame comprising a plurality of substantially flat walls having portions overlapping with portions of the other walls, a plurality of spaced apart fastener means integral to the walls and located on the overlapping portions, each of said fastener means comprising a slot formed in one of said walls, a tongue formed on the other of said walls and spaced therefrom to receive said one wall, said tongue being adapted to slip into said slot and overlie a portion of said one wall adjacent to the slot and a latching member formed on said other wall adapted to lock into the slot when said tongue overlies said one wall, said latching member including an abutment surface engagable with a peripheral surface of said slot to inhibit relative sliding movement between said walls.

2. A frame according to claim 1 wherein said abutment surface includes a portion directed oppositely to said tongue.

3. A frame according to claim 2 wherein said abutment surface includes a further portion directed generally parallel to said tongue.

4. A frame according to claim 3 wherein said latching member includes a tab inclined to the plane of said other wall and resiliently connected thereto, said abutment surface being defined by a free peripheral edge of said tab projecting above said other wall.

5. A frame according to claim 4 wherein said edge defining said further portion is generally parallel to the plane of said other wall.

6. A frame according to claim 5 wherein said edge defining said portion is inclined to the plane of said other wall.

7. A frame according to claim 4 wherein said edge defining said further portion is inclined to the plane of said other wall.

8. A frame according to claim 7 wherein said edge defining said portion is parallel to the plane of said other wall.

9. A frame according to claim 4 wherein said latching member includes a pair of tabs each having a free peripheral edge to define said abutment surface.

10. A frame according to claim 4 wherein said tongue and latching member are integrally formed with said other wall.

11. A frame according to claim 10 wherein said tongue is connected to said wall by a connector which includes a reinforcing rib to inhibit being of said tongue away from said wall.

12. A frame according to claim 10 wherein the distal end of said tongue is inclined outwardly relative to the plane of said other wall.

13. A fastening device for securing a pair of panels to one another comprising:

a) a panel retainer having a tongue integrally formed in one of the panels and spaced from but generally parallel to the panel and a connector extending from the tongue to the panel so as to provide an open channel between the panel and the tongue;

b) a latching member spaced from the tongue and providing an abutment surface having a first portion directed oppositely to the channel and a second portion directed generally transverse to said first portion;

c) an aperture in the other panel to receive the tongue, the aperture having a length to accommodate the tongue and extend beyond the latching member when the other panel is received in the channel whereby said abutment surface engages a peripheral edge of said aperture and relative movement between the panels is prohibited.

14. The fastening device claimed in claim 13 wherein the length of the aperture is substantially equal to the distance between the first portion of said abutment surface of the latching member and the channel.

15. A fastening device as claimed in claim 14 wherein said abutment surface is defined by a peripheral free edge of a tab connected to said one panel and inclined to the plane of said one wall.

16. A fastening device according to claim 15 wherein said edge defining said second portion of said abutment surface is generally parallel to the plane of said one wall.

17. A fastening device according to claim 16 wherein said edge defining said first portion of said abutment surface is inclined to the plane of said one wall.

18. A fastening device according to claim 15 wherein said latching member includes a pair of tabs each having a peripheral free edge and each inclined the plane of said one wall.

19. A fastening device according to claim 18 wherein each of said tabs is rectangular and is connected to said one panel along an edge generally normal to said first portion of said abutment surface.

20. A fastening device according to claim 19 wherein said connector includes to reinforcing rib to inhibit movement of said tongue away from said one wall.

21. A fastening device according to claim 19 wherein a distal end of said tongue is outwardly inclined.

* * * * *